US005204312A

United States Patent [19]

Sens et al.

[11] Patent Number: 5,204,312

[45] Date of Patent: Apr. 20, 1993

[54] AZO DYES FOR THERMAL TRANSFER PRINTING

[75] Inventors: Ruediger Sens, Mannheim; Gunther Lamm, Hassloch; Karl-Heinz Etzbach, Frankenthal, all of Fed. Rep. of Germany

[73] Assignee: BASF Aktiengesellschaft, Ludwigshafen, Fed. Rep. of Germany

[21] Appl. No.: 714,021

[22] Filed: Jun. 12, 1991

[30] Foreign Application Priority Data

Jun. 19, 1990 [DE] Fed. Rep. of Germany ..... 4019419

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914

[56] References Cited

U.S. PATENT DOCUMENTS 4,632,983 12/1986 Lamm ..... 534/772

FOREIGN PATENT DOCUMENTS

| | | | |
|---|---|---|---|
| 0111236 | 6/1984 | European Pat. Off. | 503/227 |
| 0133011 | 2/1985 | European Pat. Off. | 503/227 |
| 0133012 | 2/1985 | European Pat. Off. | 503/227 |
| 0192435 | 6/1986 | European Pat. Off. . | |
| 0216483 | 4/1987 | European Pat. Off. . | |
| 0227092 | 7/1987 | European Pat. Off. | 503/227 |
| 0227094 | 7/1987 | European Pat. Off. | 503/227 |
| 0302627 | 7/1988 | European Pat. Off. . | |
| 0319234 | 11/1988 | European Pat. Off. . | |
| 0323259 | 12/1988 | European Pat. Off. . | |
| 247737 | 10/1989 | European Pat. Off. . | |
| 2951403 | 12/1979 | Fed. Rep. of Germany . | |
| 6339380 | 8/1986 | Japan . | |

OTHER PUBLICATIONS

Japan Abstract, JP-A-012-393, Jan. 20, 1986.
Chemical Abstracts, 106: 166337x, & JP-A-244,595, Oct. 30, 1986, Y. Murata, et al., "Pyridoneazo Dyes for Thermal-Transfer Recording".
Japan Abstract, JP-A-262,191, Nov. 20, 1986.
Japan Abstract, JP-A-199,997, Sep. 4, 1986.
Japan Abstract, JP-A-283,595, Dec. 13, 1986.

*Primary Examiner*—B. Hamilton Hess
*Attorney, Agent, or Firm*—Oblon, Spivak, McClelland, Maier & Neustadt

[57] ABSTRACT

Azo dyes suitable for thermal transfer printing have the formula

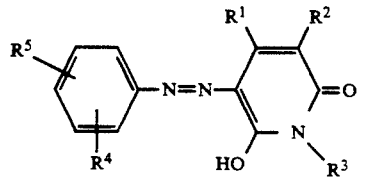

I in which the substituents have the following meanings: $R^1$ is H, amino, hydroxyl or $C_1$–$C_3$-alkyl, $R^2$ is H, acetyl, carbamoyl or cyano, $R^3$ is ω-phenoxy-, ω-tolyloxy-, ω-benzyloxy- or ω-cyclohexyloxy-$C_1$–$C_{12}$-alkyl whose carbon chain may be interrupted by one or two of the following nonadjacent members —O—, —CO—, —O—CO— or —CO—O— and which may carry one or two of the following substituents: halogen, hydroxyl, $C_1$–$C_2$-alkyl, phenyl or cyclohexyl; $R^4$ and $R^5$ are each H, halogen, cyano, nitro, trihalomethyl, or a radical of the formula —CO—H, —CO—$R^6$, —O—CO—$R^6$, —CO—O$R^6$, —SO—O$R^6$, —O—SO—O$R^6$, —CO—N$R^7R^8$, —O—CO—N$R^7R^8$, —$SO_2$—N$R^7R^8$ or —O—$SO_2$—N$R^7R^8$ where $R^6$ is $C_1$–$C_{12}$-alkyl or ω-phenoxy-, ω-tolyloxy-, ω-benzyloxy- or ω-cyclohexyloxy-$C_1$–$C_{12}$-alkyl where the carbon chain may in each case be interrupted by one or two oxygen atoms in ether function, $R^7$ is $C_1$–$C_{12}$-alkyl and $R^8$ is H or has one of the meanings of $R^7$.

4 Claims, No Drawings

AZO DYES FOR THERMAL TRANSFER PRINTING

The present invention relates to the use of azo dyes of the general formula I

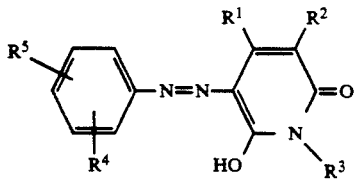

I in which the substituents have the following meanings:

$R^1$ is hydrogen, amino, hydroxyl or $C_1$–$C_3$-alkyl, $R^2$ is hydrogen, acetyl, carbamoyl or cyano, $R^3$ is ω-phenoxy-, ω-tolyloxy-, ω-benzyloxy- or ω-cyclohexyloxy-$C_1$–$C_{12}$-alkyl whose carbon chain may be interrupted by one or two of the following nonadjacent members:

—O—, —CO—, —O—CO— or —CO—O— and which may carry one or two of the following substituents: halogen, hydroxyl, $C_1$–$C_2$-alkyl, phenyl or cyclohexyl, $R^4$ and $R^5$ are each hydrogen, halogen, cyano, nitro, trihalomethyl or a radical of the formula —CO—H, —CO—$R^6$, —O—CO—$R^6$, —CO—O$R^6$, —SO—O$R^6$, —O—SO—O$R^6$, —CO—N$R^7R^8$, —O—CO—N$R^7R^8$, —$SO_2$—N$R^7R^8$ or —O—$SO_2$—N$R^7R^8$ where $R^6$ is $C_1$–$C_{12}$-alkyl or ω-phenoxy-, ω-tolyloxy-, ω-benzyloxy- or ω-cyclohexyloxy-$C_1$–$C_{12}$-alkyl, in each of which (unsubstituted as well as ω-substituted alkyl) the carbon chain may be interrupted by one or two oxygen atoms in ether function, $R^7$ is $C_1$–$C_{12}$-alkyl, and $R^8$ is hydrogen or has one of the meanings of $R^7$ for thermal transfer printing and specifically to a process for transferring these azo dyes from a transfer to a plastic-coated medium by diffusion with the aid of a thermal printing head.

The technique of thermal transfer printing is common knowledge; possible heat sources besides lasers and IR lamps are in particular thermal printing heads which are capable of emitting short heating pulses lasting fractions of a second.

In this preferred form of thermal transfer printing, a transfer sheet which contains the dye to be transferred together with one or more binders, a substrate material and possibly further assistants such as release agents or crystallization inhibitors is heated by the thermal printing head from the back. This causes the dye to migrate out of the transfer sheet, and diffuse into the surface coating of the receiving medium, for example into the plastics coating of a sheet of coated paper.

The essential advantage of this process is that the amount of dye transferred, and hence the color gradation, can be controlled via the energy to be supplied to the thermal printing head.

Thermal transfer printing generally involves the use of the three subtractive primaries yellow, magenta and cyan with or without black, to which the dyes used must have the following properties for optimal color recording: ready thermal transferability, low tendency to migrate within or out of the surface coating of the recording medium at room temperature, high thermal and photochemical stability and resistance to moisture and chemicals, no tendency to crystallize out on storage of the transfer sheet, a suitable hue for subtractive color mixing, a high molar absorption coefficient, and ready industrial accessibility.

These requirements are very difficult to meet at one and the same time. For this reason most of the yellow dyes used for thermal transfer printing do not have the required property profile. This is also true of the azopyridones disclosed and recommended for thermal transfer printing in EP-A-247 737, JP-A-12 393/1986, JP-A-244 595/1986 and JP-A-262 191/1986, which differ from the compounds I inter alia by the substituents on the pyridone nitrogen.

The azo dyes I themselves are known per se or obtainable by known methods (EP-B-111 236).

It is an object of the present invention to provide yellow dyes suitable for thermal transfer printing which come closer to the required property profile than the prior art dyes.

We have found that this object is achieved by the azo dyes I defined at the beginning.

The present invention accordingly provides a process for transferring azo dyes by diffusion from a transfer to a plastic-coated medium with the aid of a thermal printing head, which comprises using for this purpose a transfer on which there is or are one or more azo dyes I of the type defined at the beginning.

In a preferred embodiment of this process, the dyes used have the formula Ia

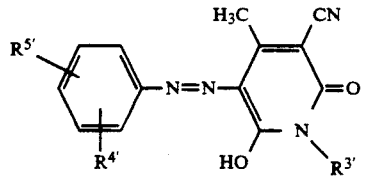

Ia in which the substituents have the following meanings:

$R^{3'}$ is ω-phenoxy-, ω-tolyloxy-, ω-benzyloxy- or ω-cyclohexyloxy-$C_1$–$C_{12}$-alkyl whose carbon chain may be interrupted by one or two oxygen atoms in ether function, $R^{4'}$ and $R^{5'}$ are each hydrogen, chlorine, cyano or a radical of the formula

—CO—O$R^6$.

Preferred $R^1$ is ethyl and propyl but in particular methyl.

Preferred $R^2$ is in particular acetyl and very particularly cyano.

Suitable alkyl $R^3$ is for example methyl, ethyl, propyl, isopropyl, butyl, isobutyl, sec-butyl, tert-butyl, pentyl, isopentyl, sec-pentyl, tert-pentyl, hexyl, 2-methylpentyl, heptyl, octyl, 2-ethylhexyl, nonyl, decyl, undecyl, dodecyl and the branched radicals of this kind which each carry in the ω-position a phenoxy, tolyloxy, benzyloxy or cyclohexyloxy group, such as in particular (where Ph=phenyl and $C_6H_{11}$=cyclohexyl):

—$(CH_2)_2$—O—Ph, —$(CH_2)_2$—O—Ph—2—$CH_3$, —$(CH_2)_2$—O—Ph—3—$CH_3$, —$(CH_2)_2$—O—$CH_2$—Ph, —$(CH_2)_2$—O—$C_6H_{11}$, —$(CH_2)_3$—O—$CH_2$—Ph, —$(CH_2)_3$—O—$C_6H_{11}$, —$(CH_2)_4$—O—Ph, —$(CH_2)_4$—O—$CH_2$—Ph, —$(CH_2)_4$—O—$C_6H_{11}$,

—$(CH_2)_{10}$—O—Ph and —$(CH_2)_4$—CH($C_2H_5$)—$CH_2$—O—Ph.

The carbon chains of the alkyls $R^3$ mentioned may each be interrupted by one or two nonadjacent members —CO—, —O—CO—, —CO—O— or in particular —O— and may carry up to two substituents such as bromine and chlorine, hydroxyl, methyl, ethyl, phenyl or cyclohexyl; examples are:

—$(CH_2)_4$—CO—$(CH_2)_4$—O—$(CH_2)_3$—O—Ph; —$(CH_2)_4$—O—CO—$(CH_2)_3$—O—Ph, —$(CH_2)_3$—O—CO—$(CH_2)_6$—O—$C_6H_{11}$; —$(CH_2)_4$—CO—O—$(CH_2)_8$—O—Ph and —$(CH_2)_3$—CO—O—$(CH_2)_6$—O—$CH_2$—Ph; particularly preferably —$(CH_2)_3$—O—$(CH_2)_2$—O—Ph, —$(CH_2)_3$—O—$(CH_2)_2$—O—Ph—2—$CH_3$, —$(CH_2)_3$—O—$(CH_2)_2$—O—Ph—3—$CH_3$, preferably —$(CH_2)_3$—O—$(CH_2)_2$—O—$CH_2$—Ph, —$(CH_2)_3$—O—$(CH_2)_2$—O—$C_6H_{11}$, —$(CH_2)_2$—O—$(CH_2)_2$—O—Ph, —[$(CH_2)_2$—O]$_2$—$(CH_2)_2$—O—Ph, —$(CH_2)_3$—O—CH($CH_3$)—$CH_2$—O—Ph, —$(CH_2)_3$—O—$(CH_2)_2$—O—$(CH_2)_2$—O—Ph, —$(CH_2)_3$—O—$(CH_2)_2$—O—$(CH_2)_2$—O—$C_6H_{11}$, —$(CH_2)_2$—O—$(CH_2)_3$—O—$CH_2$—Ph, —$(CH_2)_2$—O—$(CH_2)_2$—CH(OH)—$(CH_2)_2$—O—Ph and —$(CH_2)_3$—O—$(CH_2)_2$—CH($C_6H_{11}$)—$CH_2$—O—Ph.

$R^4$ and $R^5$ can each be in particular hydrogen, chlorine or cyano, but also fluorine, bromine, nitro or trihalomethyl such as trifluoromethyl or trichloromethyl.

Other suitable $R^4$ and $R^5$ radicals have the formulae —CO—H, —CO—$R^6$, —O—CO—$R^6$, —CO—O$R^6$, —SO—O$R^6$, —O—SO—O$R^6$, —CO—N$R^7R^8$, —O—CO—N$R^7R^8$, —$SO_2$—N$R^7R^8$ or —O—$SO_2$—N$R^7R^8$; of these, those of the formula —CO—O$R^6$ are particularly preferred.

In these formulae, $R^6$ is one of the abovementioned $C_1$–$C_{12}$-alkyl or ω-phenoxy-, ω-tolyloxy-, ω-benzyloxy- or ω-cyclohexyloxy-$C_1$–$C_{12}$-alkyl groups whose carbon chain may in each case be interrupted by one or two oxygen atoms in ether function. Suitable $R^7$ and $R^8$ radicals are the unsubstituted $C_1$–$C_{12}$-alkyl groups previously mentioned.

Examples of $R^4$ and $R^5$ are the following groups:

—CO—$CH_3$, —CO—$C_2H_5$, —CO—$C_6H_{13}$, —CO—$C_{11}H_{23}$, —CO—$(CH_2)_3$—O—$(CH_2)_2$—O—Ph, —CO—$(CH_2)_4$—O—$C_3H_7$ and —CO—$(CH_2)_8$—O—$CH_3$;

—O—CO—$CH_3$, —O—CO—$C_4H_9$, —O—CO—$C_7H_{15}$, —O—CO—$(CH_2)_3$—O—$CH_3$ and —O—CO—$(CH_2)_4$—O—$C_4H_9$; —CO—O—$CH_3$, —CO—O—$C_2H_5$, —CO—O—$C_4H_9$, —CO—O—$C_6H_{13}$, —CO—O—$C_7H_{15}$, —CO—O—$(CH_2)_4$—O—$CH_3$, —CO—O—CH($CH_3$)—$CH_2$—O—$CH_3$, —CO—O—$(CH_2)_3$—O—$C_4H_9$, —CO—O—$(CH_2)_3$—O—$C_6H_{13}$, —CO—O—$(CH_2)_2$—O—$(CH_2)_2$—O—$C_4H_9$, —CO—O—$(CH_2)_2$—O—Ph, —CO—O—$(CH_2)_3$—O—Ph, —CO—O—$(CH_2)_4$—O—Ph, —CO—O—$(CH_2)_4$—O—$C_6H_{11}$ and —CO—O—$(CH_2)_8$—O—$CH_2$—Ph;

—SO—O—$CH_3$, —SO—O—$C_2H_5$, —SO—O—$C_5H_{11}$, —SO—O—$(CH_2)_2$—O—$(CH_2)_2$—O—$CH_3$ and —SO—O—$(CH_2)_4$—O—$C_2H_5$;

—O—SO—O—$CH_3$, —O—SO—O—$C_4H_9$, —O—SO—O—$C_{10}H_{21}$, —O—SO—O—$(CH_2)_3$—O—$C_4H_9$ and —O—SO—O—$(CH_2)_5$—O—$C_3H_7$;

—CO—NH—$C_4H_9$, —CO—NH—$C_7H_{15}$, —CO—NH—$C_9H_{19}$, —CO—NH—$C_{10}H_{21}$, —CO—NH—$(CH_2)_3$—O—$(CH_2)_2$—O—$C_2H_5$, —CO—N($CH_3$)—$C_6H_{13}$, —CO—N($C_2H_5$)—$C_3H_7$ and —CO—N($C_3H_7$)—$C_3H_7$;

—O—CO—NH—$C_6H_{13}$ and —O—CO—N($C_5H_{11}$)—$C_5H_{11}$;

—$SO_2$—NH—$C_7H_{15}$, —$SO_2$—NH—$C_{10}H_{21}$, —$SO_2$—NH—$(CH_2)_3$—O—$C_2H_5$, —$SO_2$—N($C_4H_9$)—$C_4H_9$ and —$SO_2$—N($C_3H_7$)—$(CH_2)_4$—O—$C_4H_9$;

—O—$SO_2$—NH—$C_7H_{15}$ and —O—$SO_2$—N(($CH_2)_3$—O—$CH_3$)—$(CH_2)_3$—O—$CH_3$.

Preferred azo dyes I are given in the Examples.

Compared with the yellow dyes hitherto used for thermal transfer printing, the dyes I to be used according to the present invention have the following properties: ready thermal transferability despite the relatively high molecular weight, improved migration properties in the recording medium at room temperature, higher light fastness, better resistance to moisture and chemicals, better solubility in the preparation of the printing ink, higher color strength and readier industrial accessibility.

Moreover, the azo dyes I show a distinctly cleaner hue, in particular in dye mixtures, and produce improved black prints.

The transfer sheets required as dye donors for the thermal transfer process of the present invention are prepared as follows. The azo dyes I are incorporated in an organic solvent, e.g. isobutanol, methyl ethyl ketone, methylene chloride, chlorobenzene, toluene, tetrahydrofuran or a mixture thereof, with one or more binders and possibly further assistants such as release agents or crystallization inhibitors to form a printing ink in which the dyes are preferably present in a molecularly dispersed, i.e. dissolved, form. The printing ink is then applied to an inert substrate and dried.

Suitable binders for this purpose are all materials which are soluble in organic solvents and known to be useful for thermal transfer printing, eg. cellulose derivatives such as methylcellulose, hydroxypropylcellulose, cellulose acetate or cellulose acetobutyrate, in particular ethyl cellulose, ethylhydroxyethylcellulose and cellulose acetate hydrogen phthalate, starch, alginates, alkyd resins, vinyl resins such as polyvinyl alcohol or polyvinylpyrrolidone and also in particular polyvinyl acetate and polyvinyl butyrate. It is also possible to use polymers and copolymers of acrylates or their derivatives, such as polyacrylic acid, polymethyl methacrylate or styrene-acrylate copolymers, polyester resins, polyamide resins, polyurethane resins or natural resins such as gum arabic.

Frequently it is advisable to use binder mixtures, for example those of ethylcellulose and polyvinyl butyrate in a weight ratio of 2:1.

The weight ratio of binder to dye ranges in general from 8 : 1 to 1 : 1, preferably from 5 : 1 to 2 : 1.

The assistants used are for example release agents based on perfluorinated alkylsulfonamidoalkyl esters or silicones as described in EP-A-227 092 and EP-A-192 435, and in particular organic additives which prevent the transfer dyes from crystallizing out in the course of storage and heating of the inked ribbon, for example cholesterol or vanillin.

Inert substrate materials are for example tissue, blotting or parchment paper and films made of heat resistant plastics such as polyesters, polyamides or polyimides, which films may also be metal-coated.

The inert substrate may additionally have on the side facing the thermal printing head a lubricant layer to prevent sticking of the thermal printing head to the substrate material. Suitable lubricants are for example silicones or polyurethanes as described in EP-A-216 483.

The thickness of the substrate is in general from 3 to 30 μm, preferably from 5 to 10 μm.

The medium to be printed, eg. paper, must in turn have a coating of a binder which takes up the dye on printing. The materials used for this purpose are preferably polymeric materials whose glass transition temperatures $T_g$ are within the range from 50° to 100° C., eg. polycarbonates and polyesters. Further details ma be found in EP-A-227 094, EP-A-133 012, EP-A-133 011, JP-A-199 997/1986 and JP-A 283 595/1986.

The process of the present invention is carried out using a thermal printing head which is heatable to above 300° C., so that transfer of the dye takes place within a period of not more than 15 msec.

EXAMPLES

First, transfer sheets (donors) were prepared in a conventional manner from 8 μm thick polyester film, coated with an approximately 5 μm thick transfer layer of a binder B which in each case contained 0.25 g of azo dye I. The weight ratio of binder to dye was in each case 4 : 1.

The medium to be printed (receptor) was paper of approximately 120 μm thickness which had been coated with an 8 μm thick plastics layer (Hitachi Color Video Print Paper).

Donor and receptor were placed on top of one another with the coated sides next to each other, wrapped in aluminum foil and heated between two hot plates at 70°-80° C. for 2 minutes. This operation was repeated three times on similar samples at ever higher temperatures within the range from 80° to 120° C.

The amount of dye which diffuses into the plastics layer of the receptor on heating is proportional to the optical density which was determined photometrically as absorbance A after each heating to the above-specified temperatures.

The plot of the logarithm of the measured absorbances A against the reciprocal of the corresponding absolute temperature is a straight line from whose slope it is possible to calculate the activation energy $\Delta E_T$ for the transfer experiment:

$$\Delta E_T = 2.3 \times R \times \frac{\Delta \log A}{\Delta\left[\frac{1}{T}\right]} \quad R\text{: general gas constant}$$

From the plot it is additionally possible to discern the temperature T* at which the absorbance attains the value 1, ie. at which the transmitted light intensity is one tenth of the incident light intensity. The lower the values of the temperature T*, the better the thermal transferability of the investigated dye.

The table which follows lists the azo dyes I which were tested in respect of their thermal transfer characteristics together with their absorption maxima $\lambda_{max}$ [nm] measured in methylene chloride.

The table also shows the particular binder B used. The abbreviations have the following meanings: EC=ethylcellulose, PVB=polyvinyl butyrate, MX=EC:PVB=2:1.

Other characteristic data listed are the aforementioned parameters T* [°C] and $\Delta E_T$ [kcal/mol].

TABLE

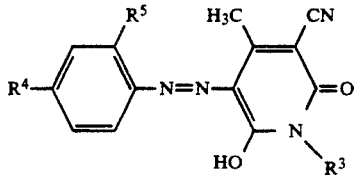

| Ex. | $R^3$ | $R^4$ | $R^5$ | B | $\lambda_{max}$ [nm] | T* [°C.] | $\Delta E_T$ [kcal/mol] |
|---|---|---|---|---|---|---|---|
| 1 | $-(CH_2)_3-O-(CH_2)_2-O-Ph$ | $-CO-O-CH_2-CH(CH_3)-CH_3$ | H | MX | 435 | 88 | 19 |
| 2 | $-(CH_2)_3-O-(CH_2)_2-O-Ph$ | $-CO-O-C_6H_{13}$ | H | MX | 435 | 84 | 11 |
| 3 | $-(CH_2)_3-O-(CH_2)_2-O-Ph$ | $-CO-O-CH(CH_3)-CH_2-O-CH_3$ | H | MX | 434 | 81 | 17 |
| 4 | $-(CH_2)_3-O-C_6H_{11}$ | $-CO-O-CH(CH_3)-CH_2-O-CH_3$ | H | MX | 433 | 83 | 17 |
| 5 | $-(CH_2)_3-O-(CH_2)_2-O-Ph$ | $-CO-O-C_2H_5$ | Br | MX | 437 | 84 | 18 |
| 6 | $-(CH_2)_3-O-(CH_2)_2-O-Ph$ | $-CO-O-C_2H_5$ | H | MX | 431 | 80 | 17 |
| 7 | $-(CH_2)_3-O-(CH_2)_2-O-C_2H_5$ | $-CO-O-(CH_2)_2-O-Ph$ | H | MX | 437 | 96 | 23 |
| 8 | $-(CH_2)_3-O-(CH_2)_2-O-Ph$ | $-CO-O-(CH_2)_2-O-Ph$ | H | MX | 434 | 101 | 17 |
| 9 | $-(CH_2)_3-O-CH_2-Ph$ | $-CO-O-(CH_2)_2-O-Ph$ | H | MX | 434 | 95 | 15 |

We claim:

1. In a process for thermal transfer printing, the improvement comprising transferring an azo dye of formula I

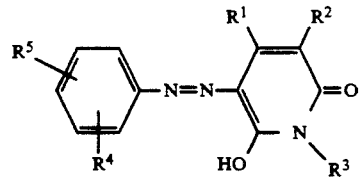

in which the substituents have the following meanings:

$R^1$ is hydrogen, amino, hydroxyl or $C_1$-$C_3$-alkyl, $R^2$ is hydrogen, acetyl, carbamoyl or cyano, $R^3$ is ω-phenoxy-, ω-tolyloxy-, ω-benzyloxy- or ω-cyclohexyloxy-$C_1$-$C_{12}$-alkyl whose carbon chain may be interrupted by one or two of the following nonadjacent members:

—O—, —CO—, —O—CO— or —CO—O— and which may carry one or two of the following substituents: halogen, hydroxyl, $C_1$-$C_2$-alkyl, phenyl or cyclohexyl, $R^4$ and $R^5$ are each hydrogen, halogen, cyano, nitro, trihalomethyl or a radical of the formula —CO—H, —CO—$R^6$, —O—CO—$R^6$, —CO—O$R^6$, —SO—O$R^6$, —O—SO—O$R^6$, —CO—N$R^7R^8$, —O—CO—N$R^7R^8$, —SO$_2$—N$R^7R^8$ or —O—SO$_2$—N$R^7R^8$ where $R^6$ is $C_1$–$C_{12}$-alkyl or ω-phenoxy-, ω-tolyloxy-, ω-benzyloxy- or ω-cyclohexyloxy-$C_1$–$C_{12}$-alkyl, in each of which the carbon chain may be interrupted by one or two oxygen atoms in ether function, $R^7$ is $C_1$–$C_{12}$-alkyl, and $R^8$ is hydrogen or has one of the meanings of $R^7$; by diffusion from a transfer source to a substrate utilizing a heat source.

2. A process as claimed in claim 1, wherein the azo dye used for this purpose has the formula Ia

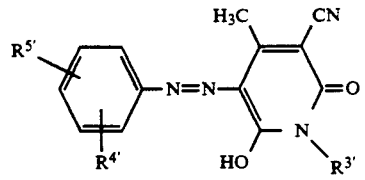

Ia in which the substituents have the following meanings:

$R^{3'}$ is ω-phenoxy-, ω-tolyloxy-, ω-benzyloxy- or ω-cyclohexyloxy-$C_1$–$C_{12}$-alkyl whose carbon chain may be interrupted by one or two oxygen atoms in ether function, $R^{4'}$ and $R^{5'}$ are each hydrogen, chlorine, cyano or a radical of the formula

—CO—O$R^6$.

3. The process of claim 1 wherein the transfer source contains one or more of the azo dyes of claim 1.

4. The process of claim 1 wherein the heat source is a thermal printing head.

* * * * *